US006102670A

United States Patent [19]

Taguchi

[11] Patent Number: 6,102,670

[45] Date of Patent: Aug. 15, 2000

[54] APPARATUS AND METHOD FOR OPERATING FLUID DISPLACEMENT APPARATUS WITH VARIABLE DISPLACEMENT MECHANISM

[75] Inventor: Yukihiko Taguchi, Maebashi, Japan

[73] Assignee: Sanden Corporation, Gunma, Japan

[21] Appl. No.: 09/149,056

[22] Filed: Sep. 8, 1998

[30] Foreign Application Priority Data

Sep. 5, 1997 [JP] Japan ..... 9-240982

[51] Int. Cl.[7] ..... F04B 1/26; F04B 49/03

[52] U.S. Cl. ..... 417/222.2; 417/270

[58] Field of Search ..... 417/222.2, 270

[56] References Cited

U.S. PATENT DOCUMENTS

| | | | |
|---|---|---|---|
| 4,606,705 | 8/1986 | Parekh | 417/222.2 |
| 4,685,866 | 8/1987 | Takenaka et al. | 417/222.2 |
| 4,702,677 | 10/1987 | Takenaka et al. | 417/222.2 |
| 4,723,891 | 2/1988 | Takenaka et al. | 417/222.2 |
| 4,730,986 | 3/1988 | Kayukawa et al. | 417/222.2 |
| 4,842,488 | 6/1989 | Terauchi | 417/222.2 |
| 4,874,295 | 10/1989 | Kobayashi et al. | 417/222.2 |
| 5,145,326 | 9/1992 | Kimura et al. . | |
| 5,318,410 | 6/1994 | Kawamura et al. . | |
| 5,785,502 | 7/1998 | Ota et al. | 417/222.2 |

FOREIGN PATENT DOCUMENTS

| | | |
|---|---|---|
| 0855506 | 7/1998 | European Pat. Off. . |
| 63-134181 | 9/1988 | Japan . |
| H474549 | 3/1992 | Japan . |

*Primary Examiner*—Henry C. Yuen
*Assistant Examiner*—Arnold Castro
*Attorney, Agent, or Firm*—Baker Botts L.L.P.

[57] ABSTRACT

A variable fluid displacement apparatus includes a plate which is located in a crank chamber and is tiltably connected to a drive shaft so as to vary the variable slant angle responsive to a pressure differential between the crank chamber and a suction chamber. A first communication path communicates the crank chamber with a discharge chamber to control pressure within the crank chamber. A first valve device opens and closes a first opening area in the first communication path to adjust the pressure level. A second valve device closes a second communication path, which communicates the crank chamber with the suction chamber. A second opening area in the second communication path is closed when a pressure difference between the crank chamber and the suction chamber falls below a predetermined value. Thus, a variable displacement compressor obtains a desired compression capacity after the variable displacement compressor commences operation.

19 Claims, 4 Drawing Sheets

APPARATUS AND METHOD FOR OPERATING FLUID DISPLACEMENT APPARATUS WITH VARIABLE DISPLACEMENT MECHANISM

BACKGROUND OF THE INVENTION

1. Field of the Invention

The present invention relates to fluid displacement apparatus and, more particularly, relates to a variable displacement mechanism of a refrigerant compressor for an automotive air conditioning system.

2. Description of Related Art

Refrigerant compressors with a variable displacement mechanisms are used in automobile air condition. A known refrigerant compressor with a variable displacement mechanism is described in Japanese Patent No. H4-74549.

A refrigerant compressor may be a wobble plate-type compressor with a variable displacement mechanism and may include a compressor housing enclosing a crank chamber. A rotor is located in the crank chamber and is attached to a drive shaft. A slant plate is attached to the rotor by a hinge mechanism. The drive shaft penetrates the slant plate, which is attached to a sleeve. The drive shaft is surrounded by the sleeve. A space is formed between the outer surface of the sleeve and the inner surface of the slant plate such that the slant plate has a slant angle for the drive shaft. The hinge mechanism allows the slant angle to be varied with regard to the drive shaft.

A wobble plate is located on the slant plate through a bearing. A plurality of piston rods are connected to the wobble plate. The piston rods have piston members which are located in cylinder portions formed in the compressor housing. The cylinder portions are formed in the compressor housing at specified intervals so as to surround the driving shaft. A guide rod is supported by the compressor housing and is parallel to the drive shaft in the crank chamber. The wobble plate is slidably attached to the guide rod.

The rotor is rotated by the rotation of the drive shaft. Because the slant plate is connected to the rotor by the hinge mechanism, the slant plate is rotated in accordance with the rotation of the rotor. With the rotation of the slant plate, the wobble plate wobbles or oscillates, and the slidably attached guide rod and piston members are reciprocated in the cylinder portions.

The compressor housing has a suction chamber and a discharge chamber. The chambers are in communication with the cylinder portion. When the piston members are reciprocated in the cylinder portions, refrigerant is taken from the suction chamber into the cylinder portions and compressed. The compressed refrigerant is discharged as a discharged gas into the discharge chamber. Because the slant plate has the variable slant angle discussed above, the stroke of each piston member varies according to the slant angle. Therefore, the compressor varies its compression capacity in relation to the variable slant angle.

First and second communication paths may be formed in the compressor. The discharge chamber communicates with the crank chamber via the first communication path. The compressor further comprises a switching valve that opens and closes the first communication path and may set the suction pressure to a predetermined level.

The crank chamber communicates with the suction chamber via the second communication path in the compressor. When the compressor has been dormant for a period of time, liquid refrigerant may exist in the low pressure side of a refrigeration circuit. This event may occur because the refrigeration circuit is connected to the compressor. Thus, the liquid refrigerant flows from the refrigeration circuit into the crank chamber through the suction chamber. More specifically, liquid refrigerant flows into the crank chamber from the suction chamber when the temperature in the engine compartment is low, such as prior to starting the automobile.

When the compressor commences operations, the opening area of the second communication path corresponds to the amount of the liquid refrigerant that exists in the crank chamber. Consequently, there is a pressure difference between the crank chamber and the suction chamber. The variable slant angle becomes a predetermined minimum angle, so that the compressor has a minimum compression capacity. Thus, it is difficult to obtain a desired compression capacity until the liquid refrigerant is sufficiently removed from the crank chamber. Therefore, the desired compression capacity may be difficult to obtain in the compressor during initial operations.

SUMMARY OF THE INVENTION

From the foregoing, it may be appreciated that a need has arisen for a fluid displacement apparatus with a variable displacement mechanism that efficiently and rapidly obtains a desired compression capacity under operating conditions.

According to the present invention, a variable fluid displacement apparatus is disclosed. The variable fluid displacement apparatus comprises a housing enclosing a crank chamber, a suction chamber, and a discharge chamber. A drive shaft is rotatably supported in the housing. A plate is located in the crank chamber. The plate has slant angle and is tiltably connected to the drive shaft so as to vary the slant angle in response to a pressure differential between the crank chamber and the suction chamber. A first communication path communicates the crank chamber with the discharge chamber. The first communication path has a first opening. A first valve device adjusts the first opening of the first communication path to control a pressure in the crank chamber. A second communication path communicates the crank chamber with the suction chamber. The second communication path has a second opening. A second valve device closes the second opening of the second communication path when the pressure differential between the crank chamber and the suction chamber is below a specified value.

Further, a method for adjusting compression capacity in a variable fluid displacement apparatus is disclosed. The variable fluid displacement apparatus comprises a housing enclosing a crank chamber, a suction chamber, a discharge chamber, and drive shaft. The method comprises six steps. The first step comprises communicating the crank chamber with the discharge chamber via a first communication path. The first communication path has a first opening area. The second step comprises communicating the crank chamber with the suction chamber via a second communication path. The second communication path has a second opening area. The third step comprises sensing a pressure in the suction chamber. The fourth step comprises adjusting the first opening area of the first communication path responsive to the sensed pressure in the sensing step. The fifth step comprises determining a pressure differential between the crank chamber and the suction chamber. The sixth step comprises closing the second opening area of the second communication path when the pressure differential is below a predetermined valve.

It is an object of the present invention to provide a variable displacement compressor capable of efficiently and rapidly obtaining a desired compression capacity after commencement of compressor operations.

Further objects, features, and advantages of this invention will be understood from the following detailed description of preferred embodiments with reference to the attached drawings.

BRIEF DESCRIPTION OF THE DRAWINGS

For a more complete understanding of the present invention and its advantages thereof, reference is now made to the following description taken in conjunction with the accompanying drawings, wherein like reference numerals represent like parts.

DESCRIPTION OF PREFERRED EMBODIMENTS

An embodiment of the present invention and its advantages may be better understood by referring now in more detail to FIGS. 1–4 of the drawings, in which like numerals refer to like parts. FIGS. 1–4 depict a fluid displacement apparatus with a variable displacement mechanism in accordance with the present invention.

Figure 1:
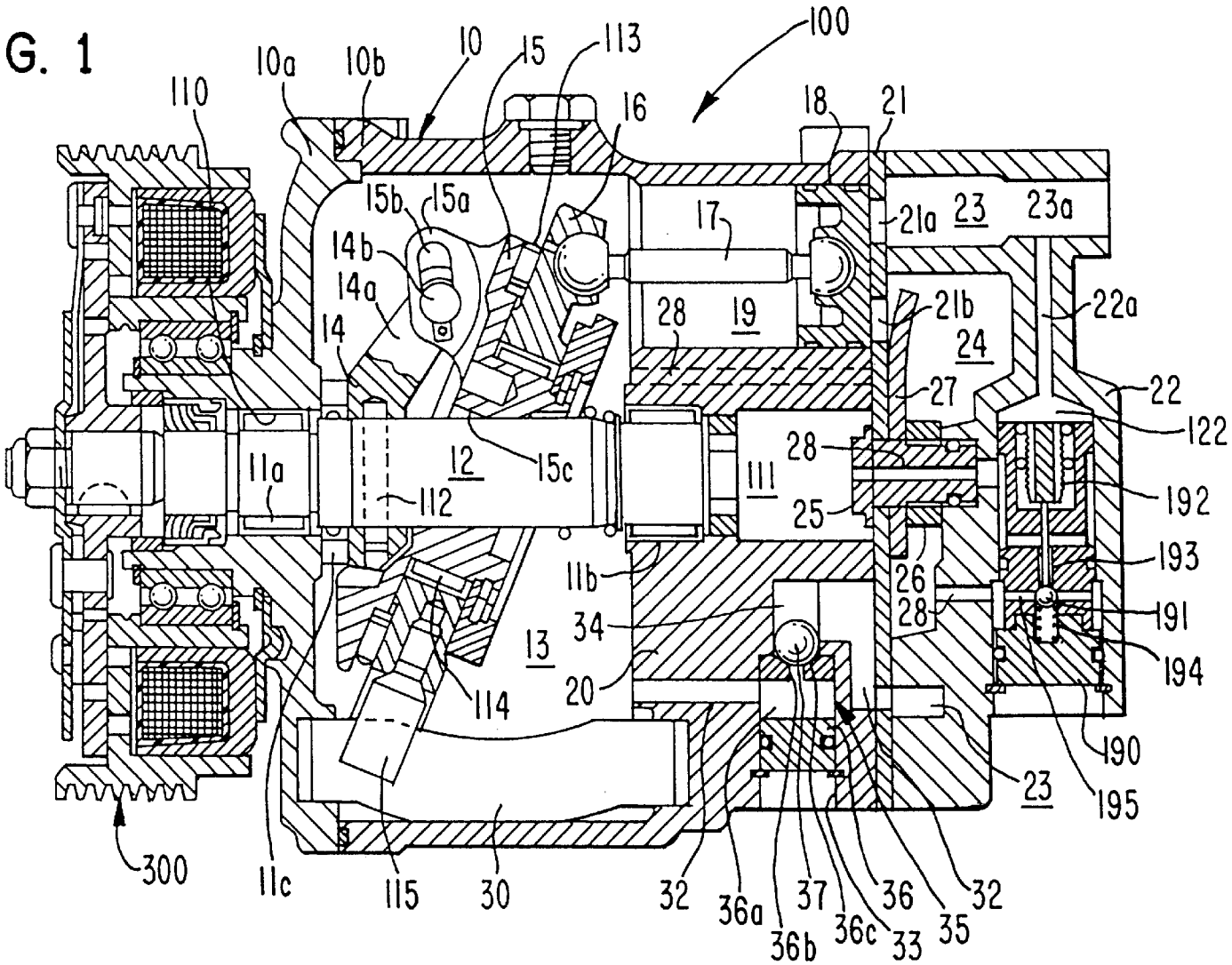
FIG. 1 depicts a first, longitudinal cross-sectional view of a slant plate-type refrigerant compressor having a variable displacement mechanism in accordance with the present invention.

Referring to FIG. 1, the construction of a slant plate-type compressor 100, such as a wobble plate-type refrigerant compressor, in accordance with an embodiment of the present invention is described. For reference, the left side of FIG. 1 will represent the front end of compressor 100. However, the following description is not intended to limit the invention in any way.

Compressor 100 includes a cylindrical housing assembly 11 having a cylinder block 20, a front end plate 10*a*, a crank chamber 13 between cylinder block 20 and front end plate 10*a*, and a rear end plate 22 attached to cylinder block 20. Front end plate 10*a* is mounted on cylinder block 20 by a plurality of bolts (not shown). Rear end plate 22 also is mounted on cylinder block 20 by a plurality of bolts (not shown). Valve plate 21 is located between rear end plate 22 and cylinder block 20. Opening 110 may be centrally formed in front end plate 10*a* and supports a drive shaft 12 along with bearing 11*a* disposed in opening 110. The inner end of drive shaft 12 is rotatably supported by bearing 11*b*, which is disposed within cylinder bore 111 of cylinder block 20. Cylinder bore 111 extends from the front end surface to the rear end surface of cylinder block 20.

Cam rotor 14 is fixed to drive shaft 12 by pin member 112, such that cam rotor 14 rotates with drive shaft 12. Thrust needle bearing 11*c* is disposed between the inner end surface of front end plate 10*a* and the adjacent axial end surface of cam rotor 14. Cam rotor 14 includes an arm 14*a* having a pin member 14*b* that extends therefrom.

Slant plate 15 includes an arm 15*a* having a slot 15*b*. Slant plate 15 is adjacent cam rotor 14. Drive shaft 12 passes through opening 15*a* in slant plate 15. Cam rotor 14 and slant plate 15 are connected by pin member 14*b*, which is inserted in slot 15*b*. Pin member 14*b* slides within slot 15*b* to adjust the angular position of slant plate 15 with respect to the longitudinal axis of drive shaft 12. Wobble plate 16 is rotatably mounted on slant plate 15 by bearings 113 and 114.

Fork shaped slider 115 is attached to the outer peripheral end of wobble plate 16, and is slidably mounted on sliding rail 30. Sliding rail 30 is between front end plate 10*a* and cylinder block 20. Fork shaped slider 115 prevents the rotation of wobble plate 16 as it nutates along rail 30 as cam rotor 14 rotates. Cylinder block 20 includes a plurality of cylinder chambers 19. A corresponding plurality of pistons 18 reciprocate with the plurality of cylinder chambers 19. Each piston 18 is connected to wobble plate 16 by a corresponding plurality of connector rods 17.

Rear end plate 22 includes annular suction chamber 23 and discharge chamber 24. Valve plate 21 is located between cylinder block 20 and rear end plate 22. Valve plate 21 also includes a plurality of valved suction ports 21*a* that link suction chamber 23 with each respective cylinder chamber 19. Valve plate 21 includes a plurality of valved discharge ports 21*b* that link discharge chamber 24 with each respective cylinder chamber 19.

Suction chamber 23 includes inlet port 23*a*, which is connected to an evaporator of the external cooling circuit (not shown). Discharge chamber 24 is provided with an outlet port (not shown) connected to a condenser of the external cooling circuit (not shown). Valve retainer 27 is affixed to valve plate 21 by bolt 25 and nut 26. Valve retainer 27 is centrally located on valve plate 21.

A first communication path 28 is created in cylinder block 20, bolt 25 and rear end plate 22 so as to communicate crank chamber 13 with discharge chamber 24. Specifically, first communication path 28 comprises three path portions. The first portion of first communication path 28 is located in cylinder block 20 and communicates crank chamber 13 with cylinder bore 111. The second portion of first communication path 28 is located in bolt 25 of rear end plate 22 and communicates cylinder bore 111 with first cylindrical bore 122, which is in fluid communication with a pressure control device 190. A third portion of first communication path 28 is located in rear end plate 22 and communicates cylindrical bore 122 with discharge chamber 24. Therefore, crank chamber 13 is in fluid communication with discharge chamber 24. Further, suction communication path 22*a* is located in rear end plate 22, and communicates first cylindrical bore 122 with suction chamber 23.

Pressure control device 190 is disposed in first cylindrical bore 122 and comprises a passage valve member 191, a bellows valve 192, a rod 193 and a spring member 194. Passage valve member 191 opens and closes first communication path 28 via fluid passage 195. Passage valve member 191 uses bellows valve 192 to open and close fluid passage 195. Bellows valve 192 has elastic members and maintains a vacuum within first cylindrical bore 122. Bellows valve 192 senses the suction pressure in suction chamber 23 through suction communication path 22*a*. Then, bellows valve 192 adjusts the opening area of passage 195 in relation to the sensed suction pressure. The motion of bellows valve 192 urges rod 193 to move passage valve member 191 to open and close passage 195.

A second communication path 32 communicates crank chamber 13 with suction chamber 23. A second cylindrical bore 33 is created in cylinder block 20 so as to be perpendicular to second communication path 32. Second cylindrical bore 33 is along the longitudinal axis, and is substantially parallel to the direction of gravitational forces when the compressor is installed on an automobile.

Valve mechanism 35 is disposed within second cylindrical bore 33. Valve mechanism 35 includes a valve body 36, a first aperture 36*a* penetrating valve body 36, a second aperture 36*b* communicating an end surface of valve body 36 with first aperture 36*a,* a valve seat 36*c* formed about second aperture 36*b* on the end surface of valve body 36, and a valve member 37 mounted on valve seat 36*c*. A valve cylinder 34 is adjacent to second cylindrical bore 33.

Preferably, valve member 37 is a ball member made of an engineering plastic, or a metal, e.g., steel or steel alloy. Valve member 37 also may have a predetermined weight. Valve member 37 is mounted on valve seat 36*c* and closes second communication path 32. Valve member 37 may move upward within valve cylinder 34 to open second communication path 32. The predetermined weight of valve member 37 is designed, such that valve member 37 opens and closes second communication path 32 responsive to the pressure level between crank chamber 13 and suction chamber 23 as slant plate 15 starts to adjust its slant angle. Specifically, second communication path 32 is closed when the pressure level between crank chamber 13 and suction chamber 23 is below a desired pressure level. Therefore, there is no communication between crank chamber 13 and suction chamber 23.

Figure 2:
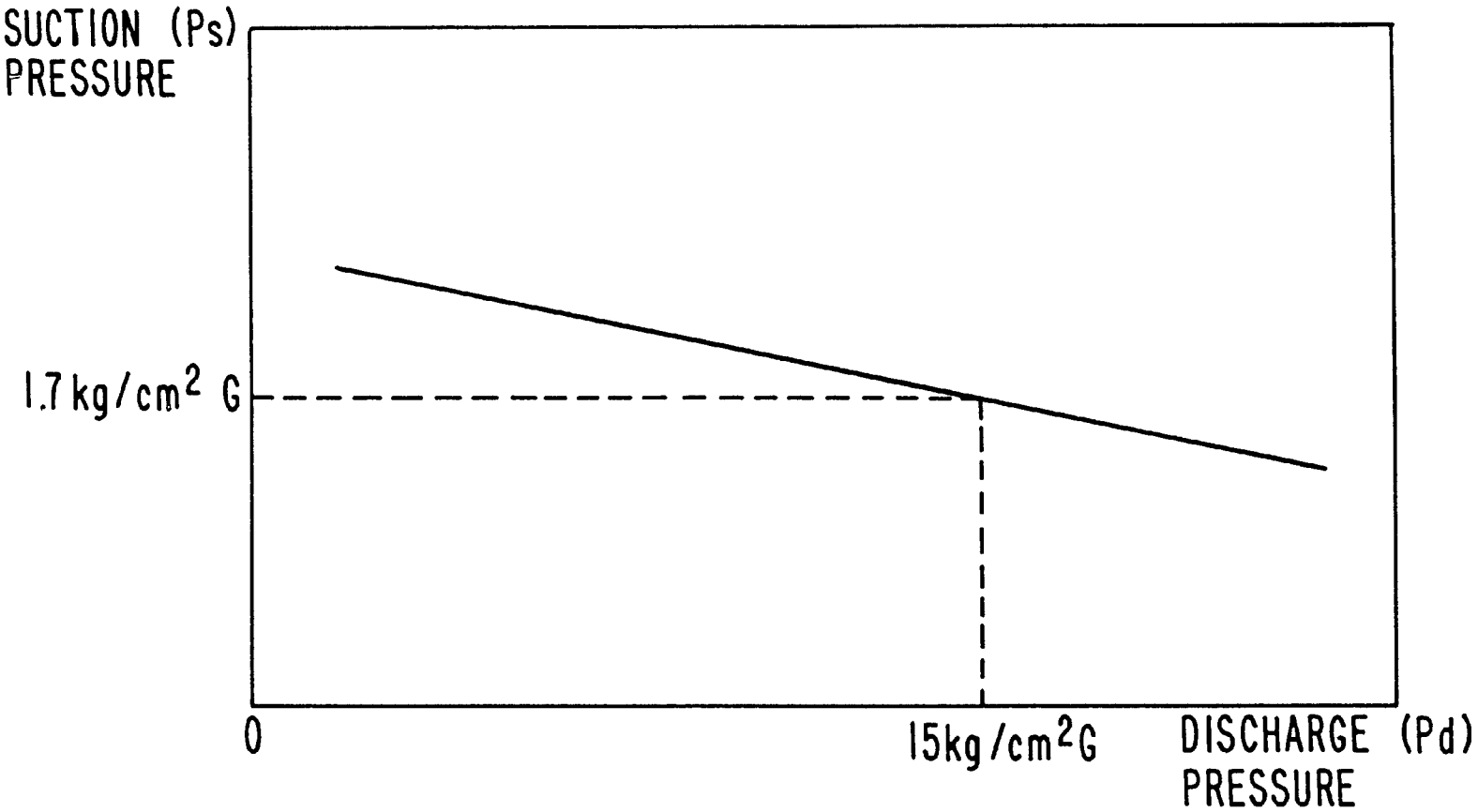
FIG. 2 is a diagram illustrating the pressure control characteristics of the pressure control valve depicted in FIG. 1.

Further, pressure control device 190 may have the pressure control characteristic illustrated by the graph in FIG. 2. In FIG. 2, a suction pressure ("Ps") linearly decreases as a discharge pressure ("Pd") increases. For example, the suction pressure (Ps) is about 1.7 kg/cm$^2$ G if the discharge pressure (Pd) is about 15 kg/cm$^2$ G.

When the compressor is not operating, the pressure level is even in the refrigerated circuit. For example, the pressure level may be about 6 kg/cm$^2$ G in the refrigerant circuit. Pressure control device 190 has a pressure control characteristic greater than this pressure. As a result, bellows valve 192 shrinks in the pressure control device 190, so that passage valve member 191 closes first communication path 28. Further, valve member 37 of valve mechanism 34 closes the second communication path 32 responsive to the pressure level in the refrigeration circuit. Accordingly, refrigerant does not flow from discharge chamber 24 to crank chamber 13 via first communication path 28 when compressor 100 is not in operation. Further, the refrigerant does not flow from suction chamber 23 to crank chamber 13 via second communication path 32 when compressor 100 is not in operation.

Figure 3:
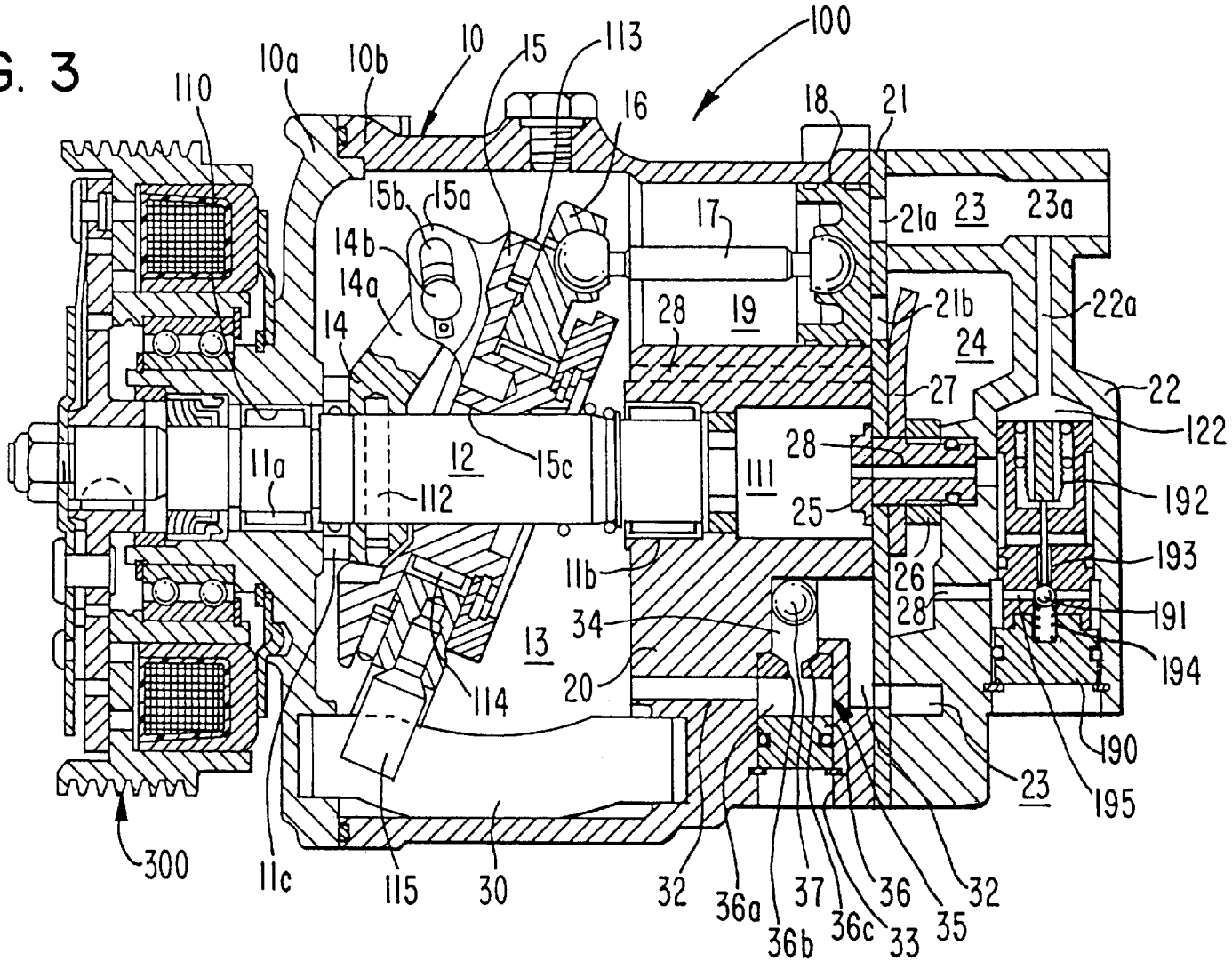
FIG. 3 depicts a second, longitudinal cross-sectional view of the slant plate-type refrigerant compressor having the variable displacement mechanism depicted in FIG. 1 with a communication passage opened by the pressure control valve.

When fluid displacement compressor 100 commences operations, the refrigerant does not flow from discharge chamber 24 to crank chamber 13 because pressure control device 190 has closed first communication path 28. Only blow-by gas exists in crank chamber 13. The blow-by gas flows from piston cylinder bore 19 to crank chamber 13 by the reciprocation of piston member 18. As a result, the pressure level is reduced in suction chamber 23. When the pressure difference between crank chamber 13 and suction chamber 23 reaches a predetermined pressure differential, valve member 37 opens second communication path 32. This action allows gas to flow from crank chamber 13 to suction chamber 23, as shown in FIG. 3.

Because the gas in crank chamber 13 is produced after compressor 100 operations commence, a negligible amount of gas flows from crank chamber 13 to suction chamber 23 through second communication path 32. As a result, the pressure level difference between crank chamber 13 and suction chamber 23 does not increase to a pressure to induce slant angle variation. Therefore, compressor 100 may be operated at an increased or maximized compression capacity at an increased or maximized slant angle of slant plate 15.

According to the present invention, the pressure level in suction chamber 23 decreases to a prescribed pressure. As a result, bellows valve 192 expands, so that transmission rod 193 urges passage valve member 191 downwardly when the suction pressure lowers to about 1.7 kg/cm$^2$ G, as depicted in FIG. 2. Consequently, passage valve member 191 opens first communication path 28. When first communication path 28 is opened by passage valve member 191, discharged gas flows from discharge chamber 24 to crank chamber 13 via first communication path 28. However, discharge gas is prevented from flowing from crank chamber 13 to suction chamber 23 via second communication path 32. Therefore, the pressure level increases in crank chamber 13. When the pressure difference between the crank chamber 13 and the suction chamber 23 increases, the slant angle of slant plate 15 may decrease so that the piston stroke may be reduced. As a result, compressor 100 is driven at a decreased compression capacity.

When the piston stroke decreases, the pressure level rises in the suction chamber 23. Consequently, bellows valve 192 shrinks in the pressure control valve device 190 and passage valve member 191 closes first communication path 28. The amount of discharged gas, which flows from discharge chamber 24 to crank chamber 13 is reduced. If the pressure difference in crank chamber 13 and suction chamber 23 decreases, the slant angle of slant plate 15 also decreases. Thus, the piston stroke increases as the slant angle of slant plate 15 decreases. Therefore, compressor 100 is driven at an increased compression capacity.

As described above, compressor 100 controls pressure control device 190, such that the pressure level in suction chamber 23 is at a desired pressure. The communication between crank chamber 13 and suction chamber 23 is closed when the differential pressure between crank chamber 13 and suction chamber 23 is below the pressure level that varies the slant angle of slant plate 15. Therefore, the refrigerant gas may not flow from suction chamber 23 to crank chamber 13 via communication path 28 when compressor 100 is not operating. As a result, compressor 100 smoothly shifts to increase or maximize compression capacity and obtains a desired compression capacity when started.

Figure 4:
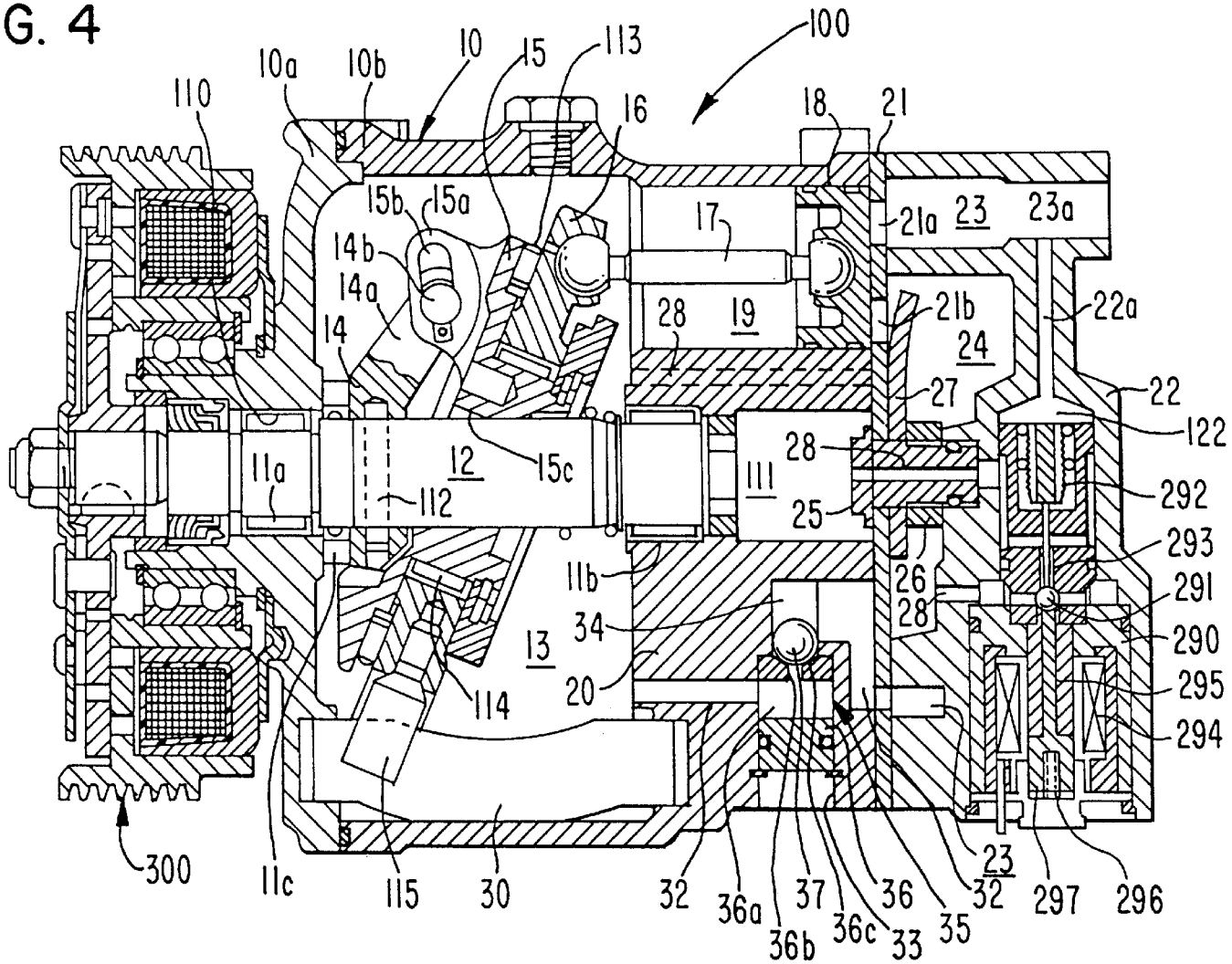
FIG. 4 depicts a third, longitudinal cross-sectional view of a slant plate-type refrigerant compressor with a variable displacement mechanism in accordance with another embodiment of the present invention.

FIG. 4 illustrates another embodiment in accordance with the present invention. Pressure control device 290 depicted in FIG. 4 differs from pressure control device 190 depicted in FIG. 1. Pressure control device 290 comprises an electromagnetic coil 294 located in cylinder head 122. The pressure control valve device 290 further comprises a plunger 297, which is surrounded by electromagnetic coil 294. Plunger 297 is movably supported by rear end plate 22 to slide up and down in cylinder head 122. Plunger 297 has a transmission rod 295, which urges passage valve member 291. Second transmission rod 293 is located opposite of transmission rod 295 through passage valve member 291.

Plunger 297 has a spring 296 that is urged upward by the spring force of spring 296. When electric power is supplied to electromagnetic coil 294, an electromagnetic force is generated around plunger 297. The electromagnetic force urges plunger 297 downward. Therefore, plunger 297 urges transmission rod 295 upward and downward in response to the electromagnetic force of electromagnetic coil 294 and the spring force of spring 296.

Consequently, passage valve member 291 is urged upward and downward by the combination of reactions by bellows valve 292, plunger 297, electromagnetic coil 294 and spring 296. Therefore, pressure control device 290 control passage valve member 291 responsive to the pressure in suction chamber 23 sensed by bellows valve 292. Bellows valve 292 operates at a prescribed suction pressure. The prescribed suction pressure may be varied in response to the electromagnetic force of electromagnetic coil 294.

Although the present invention has been described in connection with preferred embodiments, the invention is not limited thereto. Specifically, while the foregoing preferred embodiments illustrate the invention in a wobble plate-type compressor, this invention is not restricted to the wobble plate-type compressors, but may be employed in other types of refrigerant compressors. Accordingly, the embodiments and features disclosed herein are provided by way of example only. It may be easily understood by those of ordinary skill in the art that variations and modifications may readily be made within the scope of this invention as defined by the following claims.

What is claimed is:

1. A variable fluid displacement apparatus, comprising:

a housing enclosing a crank chamber, a suction chamber, and a discharge chamber;

a drive shaft rotatably supported in said housing;

a plate in said crank chamber, said plate having a slant angle and tiltably connected to said drive shaft, said slant angle varies in response to a pressure differential between said crank chamber and said suction chamber;

a first communication path communicating said crank chamber with said discharge chamber, said first communication path having a first opening area;

a first valve device for adjusting said first opening area of said first communication path responsive to a pressure in said suction chamber;

a second communication path communicating said crank chamber with said suction chamber, said second communication path having a second opening area; and a second valve device closing said second opening area of said second communication path when said pressure differential between said crank chamber and said suction chamber is below a valve member's weight.

2. The variable fluid displacement apparatus of claim 1, wherein said second valve device comprises a valve member, a valve seat for receiving said valve member, and a value body supporting said value seat.

3. The variable fluid displacement apparatus of claim 2, wherein said valve member closes said second opening area of said second communication path.

4. The variable fluid displacement apparatus of claim 2, wherein said valve member of said second valve device is a ball member.

5. The variable fluid displacement apparatus of claim 4, wherein said ball member is metal.

6. The variable fluid displacement apparatus of claim 1, wherein said first valve device senses said suction pressure of said suction chamber and adjusts said first opening area of said first communication path in response to said sensed suction pressure.

7. The variable fluid displacement apparatus of claim 6, wherein said first valve device further comprises:

valve means for opening and closing said first opening area of said first communication path; and a bellows member for sensing said sensed suction pressure and urging said valve means to open and close said first communication path.

8. The variable fluid displacement apparatus of claim 7, wherein said valve means comprises a passage valve member for adjusting said first opening area of said first communication path, and means for supplying a force to said passage valve member to close said first communication path, said bellows member urges said passage valve member against said force supplying means to open said first communication path.

9. The variable fluid displacement apparatus of claim 8, wherein said force supplying means is a spring.

10. The variable fluid displacement apparatus of claim 8, wherein said force supplying means includes an electromagnetic coil for generating an electromagnetic force, and a means for converting said electromagnetic force into a physical force.

11. The variable fluid displacement apparatus of claim 1, wherein said first valve device has a pressure control characteristic such that said suction pressure decreases as a discharge pressure increases.

12. A variable fluid displacement apparatus, comprising:

a housing enclosing a crank chamber, a suction chamber, and a discharge chamber;

a drive shaft rotatably supported in said housing;

a plate in said crank chamber, said plate having a slant angle and tiltably connected to said drive shaft, said slant angle varies in response to a pressure differential between said crank chamber and said suction chamber;

a first communication path communicating said crank chamber with said discharge chamber, said first communication path including a first opening area;

a first valve device that senses a suction pressure of said suction chamber and adjusts said first opening area of said first communication path in response to said suction pressure;

a bellows member in said first valve device for sensing said suction pressure, wherein said bellows member urges a valve means to open and close said first communication path;

a second communication path communicating said crank chamber with said suction chamber, said second communication path having a second opening area; and a second valve device comprising a valve member, a valve seat receiving said valve member and a valve body supporting said valve seat, wherein said valve member closes said second opening area of said second communication path when said pressure differential between said crank chamber and said suction chamber is below a valve member's weight.

13. The variable fluid displacement apparatus of claim 12, wherein said valve member of said second valve device is a ball member.

14. The variable fluid displacement apparatus of claim 12, wherein said valve means in said first valve device comprises a passage valve member for adjusting said first opening area of said first communication path, and means for supplying a force to said passage valve member to close said first communication path.

15. The variable fluid displacement apparatus of claim 14, wherein said bellows member of said first valve device urges said passage valve member against said force supplying means to open said first communication path.

16. A method for adjusting compression capacity in a variable fluid displacement apparatus comprising a housing enclosing a crank chamber, a suction chamber, a discharge chamber, and drive shaft, the method comprising the steps of:

communicating said crank chamber with said discharge chamber via a first communication path having a first opening area;

communicating said crank chamber with said suction chamber via a second communication path having a second opening area;

sensing a pressure in said suction chamber;

adjusting said first opening area of said first communication path responsive to said sensed pressure in said sensing step;

determining a pressure differential between said crank chamber and said suction chamber; and closing said second opening area of said second communication path when said pressure differential is below a valve member's weight.

17. The method of claim 16, wherein said adjusting step further comprises opening and closing said first opening area with a bellows member and a valve means, said bellows member urging said valve means to open and close said first opening area.

18. The method of claim 17, wherein said opening and closing step further comprises:

supplying a force to a passage valve member in said valve means to close said first communication path; and urging said passage valve member against said force to open said first communication path.

19. The method of claim 16, wherein said closing step further comprises moving a valve member in a valve device to close said second opening area when said pressure differential is below said valve member's weight.

* * * * *